United States Patent [19]

Naniwa et al.

[11] Patent Number: 4,609,234

[45] Date of Patent: Sep. 2, 1986

[54] DOOR HINGE DEVICE FOR A REPOSITORY

[75] Inventors: Isao Naniwa, Oosaka; Kazuo Nishida, Ootsu; Kiyoshi Yoshihara, Oosaka, all of Japan

[73] Assignee: Tokyo Shibaura Denki Kabushiki Kaisha, Kawasaki, Japan

[21] Appl. No.: 496,990

[22] Filed: May 23, 1983

[30] Foreign Application Priority Data

Sep. 14, 1982 [JP] Japan ..... 57-160260

[51] Int. Cl.[4] ..... E05D 15/02

[52] U.S. Cl. ..... 312/296; 16/341; 16/361; 16/364

[58] Field of Search ..... 16/341, 342, 350, 356, 16/361, 364

[56] References Cited

U.S. PATENT DOCUMENTS

| | | | |
|---|---|---|---|
| 442,689 | 12/1890 | Porter | 16/350 |
| 1,236,138 | 8/1917 | Bernard | 16/350 |
| 2,074,112 | 3/1937 | Homan | 16/360 |
| 2,353,671 | 7/1944 | Karish | 16/341 |
| 2,492,478 | 12/1949 | Homan | 16/360 |
| 3,097,029 | 7/1963 | Lotz | 16/350 |

FOREIGN PATENT DOCUMENTS

| | | |
|---|---|---|
| 3319757 | 9/1984 | Fed. Rep. of Germany . |
| 36-626459 | 10/1961 | Japan . |
| 57-73383 | 5/1982 | Japan . |
| 1065813 | 6/1964 | United Kingdom . |
| 1071203 | 3/1965 | United Kingdom . |
| 1112979 | 7/1965 | United Kingdom . |
| 1258467 | 12/1971 | United Kingdom . |

*Primary Examiner*—James T. McCall
*Assistant Examiner*—Joseph Falk
*Attorney, Agent, or Firm*—Cushman, Darby & Cushman

[57] ABSTRACT

A door hinge device comprises a door support member and a door mounting member. The door support member is provided with a tongue, and is attached to a refrigerator housing. The door mounting member is attached to a door, and is provided with a second coupling portion connected to the tongue. A shaft and a guide pin stand on the tongue, and each is loosely fitted with a cylindrical collar. The door mounting member is provided with a shaft fitting slot which extends along the depth of the refrigerator housing when the door is closed, and the shaft is fitted in the shaft fitting slot. A guide recess is formed at the rear portion of the second coupling portion to engage the guide pin. The guide recess and the guide pin jointly move the shaft along the shaft fitting slot when the door is located near the position to close an opening of the refrigerator housing, and rocks the shaft relative to the shaft fitting slot until a given angle is formed between the door and the refrigerator housing when the door is kept away from the position to close the opening.

14 Claims, 19 Drawing Figures

DOOR HINGE DEVICE FOR A REPOSITORY

BACKGROUND OF THE INVENTION

This invention relates to a door hinge device for pivotally supporting a door to open and close a front opening of a repository such as a refrigerator, more specifically to a door hinge device so designed that, in opening a door of a repository, the door is moved forward as a whole from the housing of the repository before it is swung open.

FIG. 1 is a general view of a prior art refrigerator, and FIG. 2 shows a door hinge device for the refrigerator. A refrigerator housing 3 comprises a refrigeration chamber 4 and a freezing chamber 5 situated above the same. Doors 1 and 2 to open and close the refrigeration chamber 4 and the freezing chamber 5, respectively, are swingably supported by hinge pins 7 on a side edge of the refrigerator housing 3. Sealing members 6 are arranged individually on the four edge portions of each of the doors 1 and 2. Thus, when the door 1 or 2 is closed, the refrigeration chamber 4 or the freezing chamber 5 is kept airtight and thermally insulated. In this conventional refrigerator, the door 1 or 2 swings around the hinge pins 7, so that when the door 1 or 2 is opened or closed those portions 6*a* of the sealing members 6 near the hinge pins 7 rub against those portions 3*a* of the edge of the refrigerator housing 3 which face the portions 6*a*. The sliding contact between the portions 6*a* and 3*a* impedes the smooth the swinging action of the door 1 or 2, and distorts and wears the portions 6*a* of the sealing members 6. Thus, the functional life of the sealing members 6 is short. Moreover, cold air may leak from the freezing chamber 5 or the refrigeration chamber 4 through the distorted portions of the sealing members 6, so that the refrigerator requires extra power consumption.

SUMMARY OF THE INVENTION

An object of this invention is to provide a door hinge device for a repository enabling the door of the repository to be opened and closed without sliding contact between sealing members and the housing of the repository or the door.

Another object of the invention is to provide a door hinge device for a repository, whereby, in opening the door of the repository, the door begins swinging after it has moved forward as a whole from the housing of the repository, and whereby, in closing the door, the door is moved back as a whole toward the repository housing after it has finished swinging.

Still another object of the invention is to provide a door hinge device for a repository which is capable of smoothly opening and closing the door of the repository.

A further object of the invention is to provide a door hinge device for a repository which will improve the lifespan of sealing members.

An additional object of the invention is to provide a door hinge device for a repository which will reduce power consumption.

According to this invention, there is provided a door hinge device for a repository which comprises a repository housing having an opening in one face thereof and an edge portion defining the opening, a door member to open and close the opening of the repository housing, and a sealing member sandwiched between the edge portion and the door member to seal the door member and the repository housing when the opening of the repository housing is closed by the door member. A door support member of the door hing device is provided near the edge portion of the repository housing, having a first coupling portion. A door mounting member is attached to that portion of the door member which corresponds in position to the door support member, having a second coupling portion connected to the first coupling portion. Protruding means is attached to the first or second coupling portion, while support means is attached to the other coupling portions. The support means supports the protruding means so that the protruding means can swing relative to the support means and move in the direction of the depth of the repository housing. First and second restricting means are attached to the first and second coupling portions, respectively. The first and second restricting means jointly move the protruding means in the depth direction of the repository housing when the door member is located near the position to close the opening of the repository housing, and swing the protruding means relative to the support means until a given angle is formed between the door member and the repository housing when the door member is kept away from the position to close the opening.

DETAILED DESCRIPTION OF THE PREFERRED EMBODIMENTS

Figure 1:
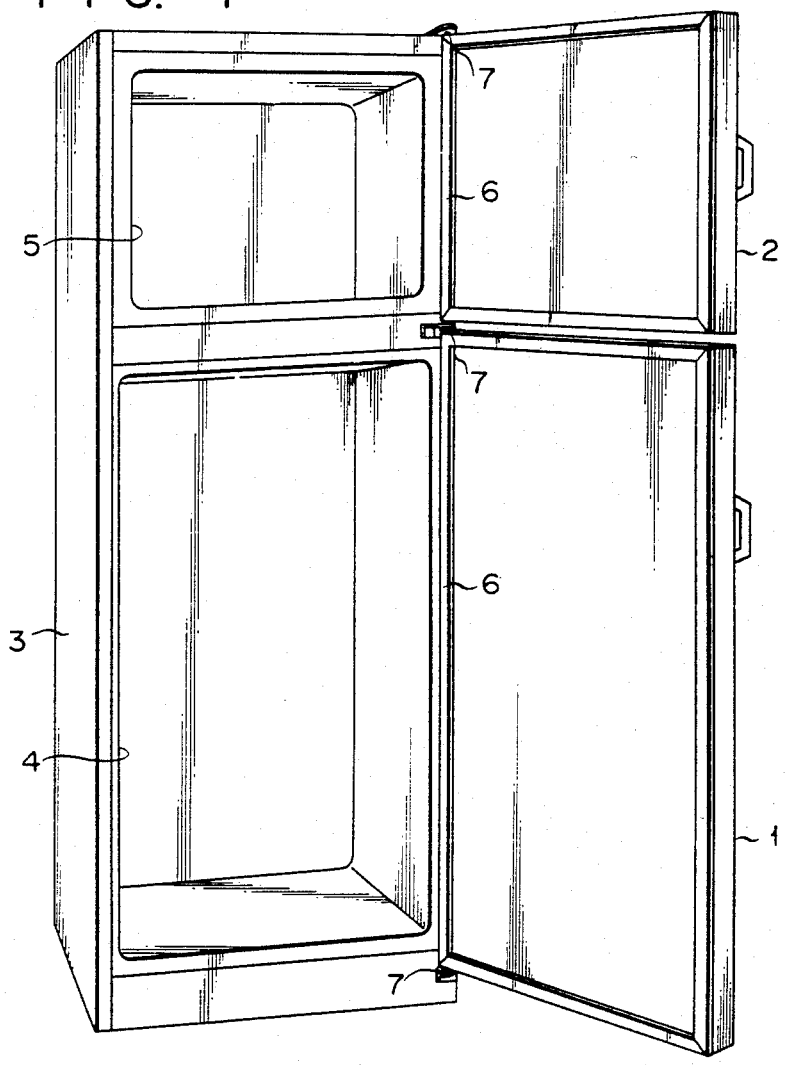
FIG. 1 (PRIOR ART)
FIG. 1 is a general perspective view of a prior art refrigerator.
Figure 2:
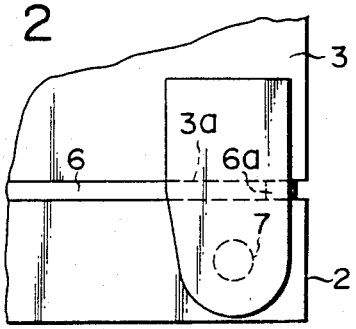
FIG. 2 (PRIOR ART)
FIG. 2 is a plan view showing a door hinge device used in the prior art refrigerator.
Figure 3:
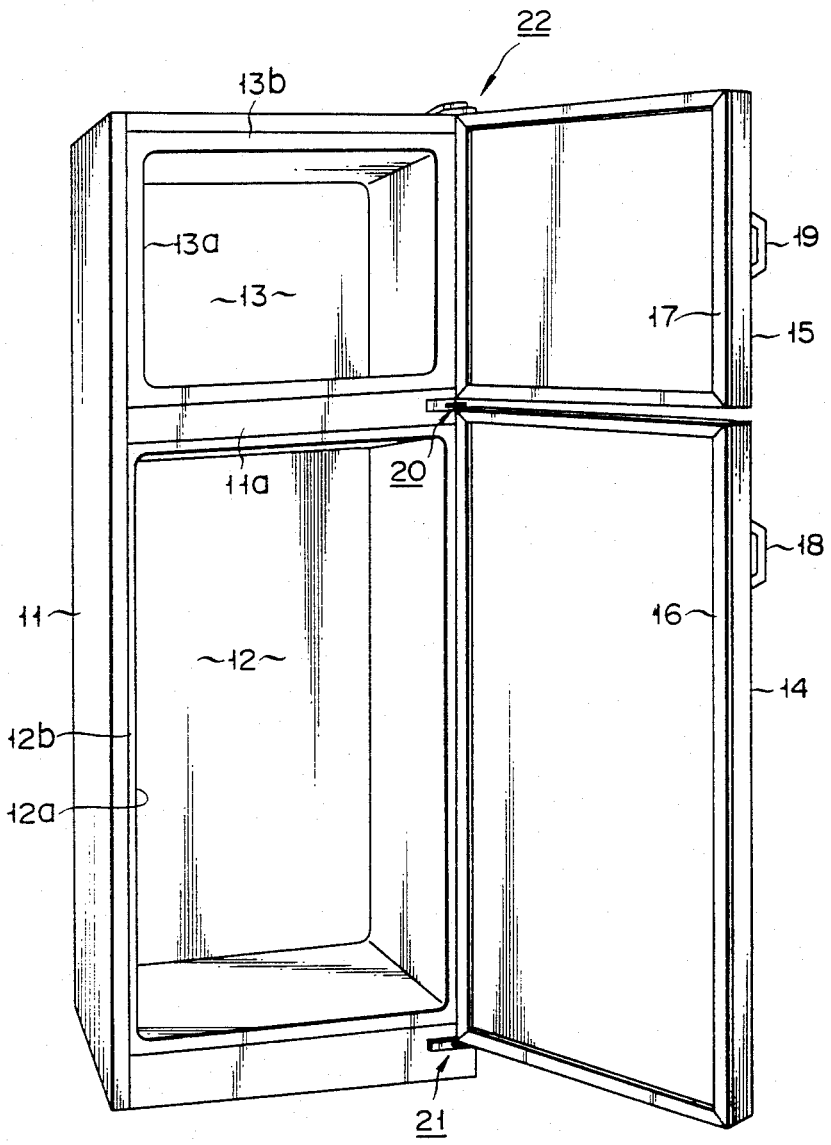
FIG. 3 a general perspective view of a refrigerator using door hinge devices according to embodiments of this invention.

FIG. 3 is a general view of a refrigerator as an example of a repository. A refrigerator housing 11 is divided by a partition wall 11*a* into upper and lower halves, i.e., a freezing chamber 13 and a refrigeration chamber 12. The chambers 12 and 13 have openings 12*a* and 13*a*, respectively, in the front face of the refrigerator housing 11. The openings 12*a* and 13*a* are defined by edge portions 12*b* and 13*b*, respectively. On the right-hand side edge of the refrigerator housing 11, door hinge devices 20, 21 and 22 according to embodiments of this invention are arranged between the freezing chamber 13 and the refrigeration chamber 12 and at the lower and upper portions of the refrigerator housing 11, respectively. A door 14 to open and close the opening 12*a* of the refrigeration chamber 12 is swingably supported on the refrigerator housing 11 by the door hinge devices 20 and 21 at its upper and lower ends, respectively. A door 15 to open and close the freezing chamber 13 is swingably supported on the refrigerator housing 11 by the door hinge devices 22 and 20 at its upper and lower ends, respectively. Sealing members 16 and 17 are attached to the respective four edge portions of the rectangular inner surfaces of the doors 14 and 15. When the doors 14 and 15 are closed, therefore, the sealing members 16 and 17 are sandwiched between the doors 14 and 15 and the edge portions 12*b* and 13*b* of the refrigeration chamber 12 and the freezing chamber 13, respectively, so that the chambers 12 and 13 are kept airtight and thermally insulated. Handles 18 and 19 are respectively attached to those end portions of the outer surfaces of the doors 14 and 15. The doors 14 and 15 may be opened by pulling the handles 18 and 19 toward the user.

Figure 4:
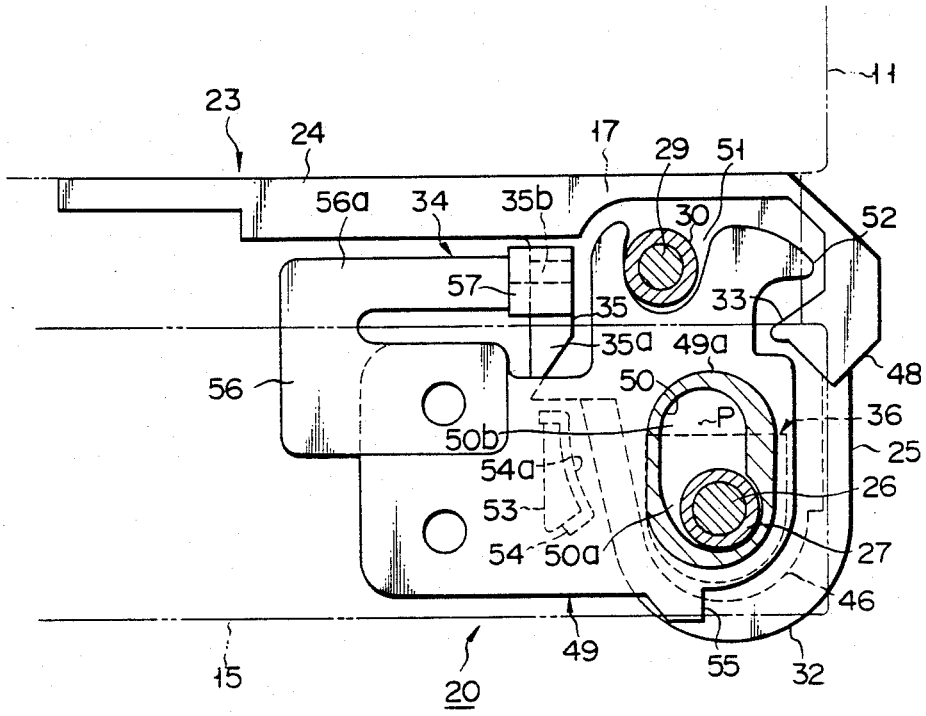
FIG. 4 is an enlarged cross-sectional view of a door hinge device at the middle portion of a side edge of the refrigerator of FIG. 3.
Figure 5:
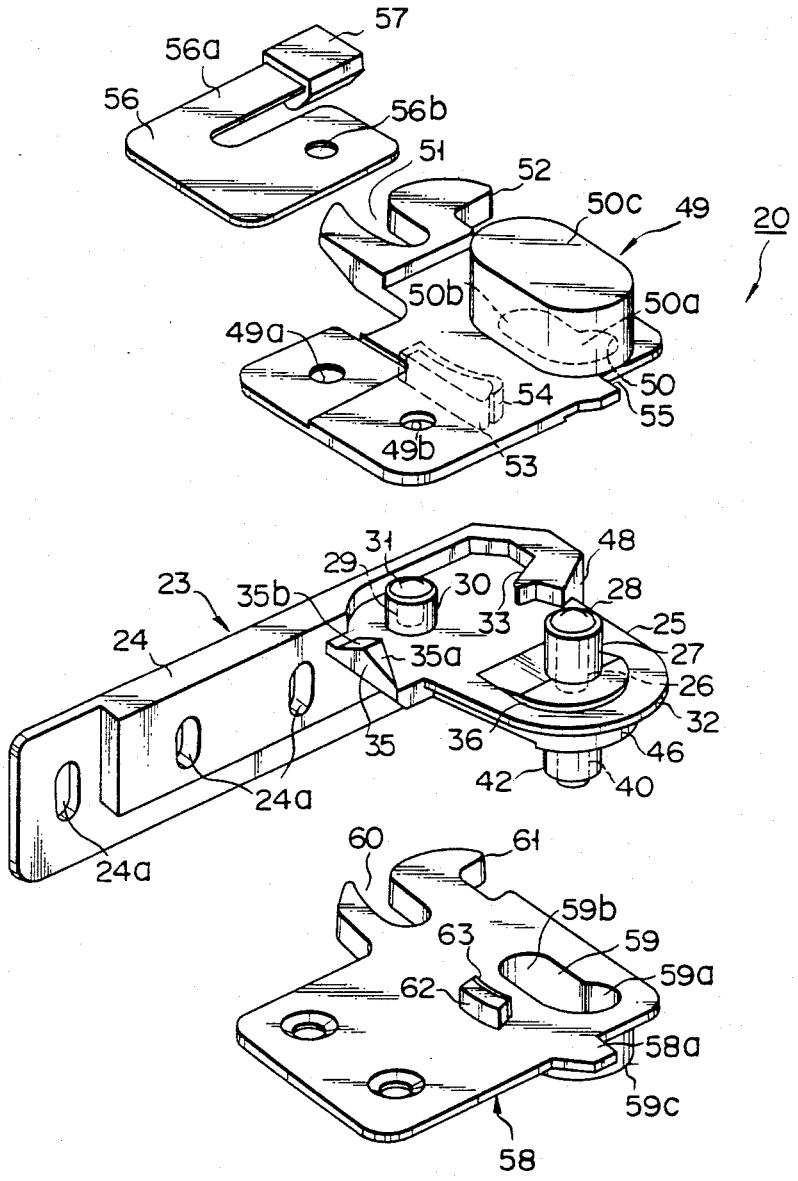
FIG. 5 disassembled perspective view of the door hinge device of FIG. 4.
Figure 6:
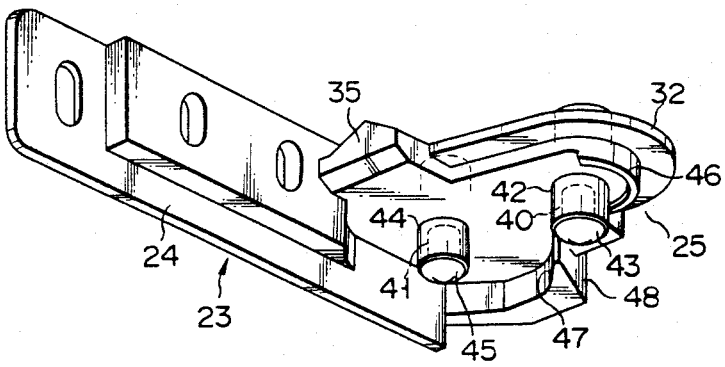
FIG. 6 is a perspective underside view of a door support member of the door hinge device of FIG. 4.
Figure 7:
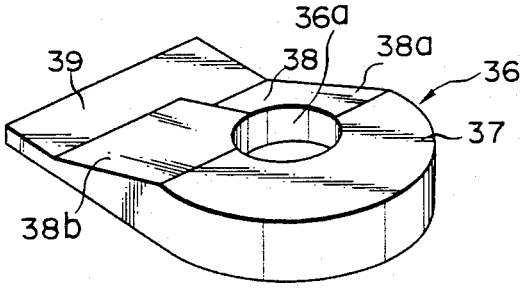
FIG. 7 is a perspective view of a spacer of the door hinge device.

Referring now to FIGS. 4 to 7, the door hinge device 20 will be described in detail. In FIG. 4, the refrigerator housing 11, sealing member 17 and door 15 are shown by two dot-chain lines. A door support member 23 of the door hinge device 20 includes an elongated mounting portion 24 and a tongue 25 at one end portion of the mounting portion 24. Three holes 24*a* are bored through the mounting portion 24. The mounting portion 24 is fixed to the right-hand end portion of the partition wall 11*a* of the refrigerator housing 11 by means of bolts (not shown) fitted in the holes 24*a*. The tongue 25 is a substantially horizontal flat member, and is formed integrally with the mounting portion 24 so as to extend in front of the refrigerator housing 11. A shaft 26 fixedly stands on the front end portion of the upper surface of the tongue 25. A cylindrical collar 27 is loosely fitted on the shaft 26 to permit rotation and is prevented from slipping off the shaft by screw 28 attached to the upper end portion of the shaft 26. A spacer 36, as shown in FIG. 7, is fitted on the lower end portion of the shaft 26 and is fixed to the tongue 25. The spacer 36 is formed from plastic or other suitable material. The front end portion of the spacer 36 on the front side of the refrigerator housing 11 is thick, while the rear end portion is thin. Flat surfaces 37 and 39 are formed on the upper surfaces of the front and rear end portions, respectively, of the spacer 36 and a slanting surface 38 angled down toward the rear end portion lies between the two flat surfaces 37 and 39. The slanting surface 38 is divided into right and left halves 38*a* and 38*b*. The right half 38*a* is formed nearer to the front end portion than the left half 38*b*, so that the right half portion of the flat surface 37 is narrower than the left half portion thereof. A hole 36*a* is bored across the thickness of the spacer 36 substantially in the center of the boundary between the flat surface 37 and the slanting surface 38. The shaft 26 is to be inserted in the hole 36*a*. The front end edge of the tongue 25 is in the shape of a semicircular arc around the shaft 26. A guide surface 32 is defined by the arcuate end edge.

A guide pin 29 stands on the rear end portion of the upper surface of the tongue 25. A cylindrical collar 30 is loosely fitted on the guide pin 29 so as to be able to rock relative to the guide pin 29. The collar 30 is prevented from slipping off the guide pin 29 by a screw 31 attached to the upper end portion of the guide pin 29. The right end portion of the tongue 25 is raised above the level of the surface from which the guide pin 29 protrudes. A guide 33 is defined by that lateral face of the raised portion which is opposed to the guide pin 29. The guide 33 is slanted toward the front of the refrigerator housing 11 so that the extension of its surface passes halfway between the guide pin 29 and the shaft 26. A chevron-shaped protrusion 35 is formed at the left rear end portion of the upper surface of the tongue 25. The protrusion 35 has a summit portion in the center thereof as viewed along the depth direction of the refrigerator housing 11, and slanting surfaces 35*a* and 36*a* in front of and behind the summit portion.

As shown in FIG. 6, a shaft 40 and a guide pin 41 protrude downward from the lower surface of the tongue 25 right under the shaft 26 and the guide pin 29, respectively. Like the collar 27, a cylindrical collar 42 is loosely fitted on the shaft 40, and is prevented from slipping off therefrom by a screw 43. Like the collar 30, a cylindrical collar 44 is loosely fitted on the guide pin 41, and is prevented from slipping off therefrom by a screw 45. The front end portion of the lower surface of the tongue 25 is stepped so that its peripheral edge portion is thinner. The front side face of the stepped portion is curved in a semicircular arc around the shaft 40 to serve as a guide surface 46. The lower surface of the tongue 25 is stepped to form a guide 47 right under the guide 33. The guide 47 extends in the same direction as the guide 33. A stopper 48 is formed at the right end portion (as one faces the front of the refrigerator housing 11) of the tongue 25.

A door mounting member 49 is generally in the form of a flat plate which has holes 49*a* and 49*b* at the left side portion. The door mounting member 49 is fixed to the lower end portion of the ring side edge of the door 15 by means of screws (not shown) fitted in the holes 49*a* and 49*b*. A substantially elliptical shaft fitting slot 50 extending along the depth of the refrigerator housing 11 is formed at the right side portion of the door mounting member 49. A front portion 50*a* of the shaft fitting slot 50 is slightly biased to the right as compared to a rear portion 50*b*thereof. Namely, the slot 50 is somewhat bent in the middle. The width of the shaft slot 50 is a little greater than the outside diameter of the collar 27 of the shaft 26. Thus, fitted in the slot 50, the collar 27 can move along the longitudinal direction of the shaft slot 50 between the front and rear portions 50*a* and 50*b* thereof. The rear edge portion of the slot 50 is in the form of an arc of a circle whose diameter is a little greater than the outside diameter of the collar 27. Having the collar 27 fitted in the rear portion 50*b*, therefore, the shaft 26 can rock relative to the slot 50. A covering portion 50*c* in the form of a bottomed elliptic cylinder, whose opening edge resembles the peripheral edge of the slot 50 in shape, is provided on the upper surface of the door mounting member 49 so that its opening faces the slot 50 in a corresponding manner. The height of the covering portion 50*c* is greater than that of the shaft 26. A guide recess 51 is formed at the rear end portion of the door mounting member 49. A guide click 52 projecting to the right is formed on the right of the guide recess 51. The collar 30 of the guide pin 29 is engaged with the guide recess 51 when the collar 27 of the shaft 26 is fitted in the front portion 50*a* of the slot 50.

The lower surface of the door mounting member 49 has a depression which corresponds to the configuration of the flat surfaces 37 and 39 and the slanting surface 38 of the spacer 36 at the position corresponding to the spacer 36 when the collar 27 of the shaft 26 is located in the front portion 50*a* of the slot 50. When the shaft 26 moves to the front portion 50*a* of the slot 50, therefore, the door mounting member 49 is lowered to rest on the tongue 25 so that the depression in the lower surface of the door mounting member 49 engages the spacer 36. A rocking guide 53 is provided on the lower surface of the door mounting member 49 on the left of the shaft slot 50. A plastic slider 54 is attached to that surface of the rocking guide 53, which faces the slot 50. A sliding contact surface 54*a* of the slider 54 is curved in the shape of a circular arc around the center P of the rear portion 50*b*. The radius of curvature of the sliding contact surface 54*a* is substantially equal to that of the guide surface 32. Accordingly, when the shaft 26 is in the rear portion 50*b* of the slot 50, the door mounting member 49 rocks relative to the door support member 23 with the sliding contact surface 54*a* of the slider 54 sliding on the guide surface 32. A stopper receiver 55 is formed at the front end portion of the door mounting member 49. The stopper receiver 55 engages the stopper 48 of the door support member 23 to prevent the door mounting member 49 from rocking further when the door mounting member 49 rocks in the door opening direction to be at a given angle to the door support member 23 with the shaft 26 in the rear portion 50*b*. The door mounting member 49, the covering portion 50*c*, the guide recess 51, and the guide click 52 may be integrally formed from zinc material by die casting or another method.

A U-shaped flat moving member 56 is laid on the door mounting member 49 with a hole 56*b* at one end portion of the moving member 56 in alignment with the hole 49*a* of the door mounting member 49. Sandwiched between the door mounting member 49 and the door 15, the moving member 56 is fixed to the door mounting member 49 by means of bolts fitted in the holes 49*a* and 56*b*. An arm portion 56*a* at the other end portion of the mounting member 56 has elasticity, and is fitted with a slider 57 at the extreme end portion. The lower surface of the slider 57 is slanted so that the slider 57 has a V-shaped cross section. When the door 15 is closed, therefore, the slider 57 gets over the protrusion 35 of the tongue 25 so that the front slanting surface of the slider 57 engages the slanting surface 35*b* of the protrusion 35, as shown in FIG. 4. Thus, the protrusion 35 of the tongue 25, the moving member 56, and the slider 57 constitute a toggle joint 34, whereby the door 14 will be prevented from being opened unexpectedly once it is closed.

A door mounting member 58 attached to the upper end portion of the door 14 forms a substantially symmetrical configuration with the door mounting member 49. Formed in the door mounting member 58 is a substantially elliptical shaft fitting slot 59 extending along the depth of the refrigerator housing 11 to receive the collar 42 loosely fitted on the shaft 40. A covering portion 59*c* in the form of a bottomed elliptic cylinder is provided on the lower surface of the door mounting member 58 is alignment with the shaft slot 59. A rocking guide 62 is provided on the upper surface of the door mounting member 58, and a slider 63 is attached to that surface of the rocking guide 62 which faces the shaft slot 59. The sliding contact surface of the slider 63 is curved with a radius of curvature substantially equal to that of the guide surface 46. A guide recess 60 is formed at the rear end portion of the door mounting member 58. A guide click 61 projecting to the right is formed on the right of the guide recess 60. Having its collar 42 fitted in the slot 59, therefore, the shaft 40 can move relative to the slot 59 along the longitudinal direction between the front and rear portions 59*a* and 59*b*. When the shaft 40 is in the rear portion 59*b*, the door mounting member 58 can rock relative to the door support member 23 with the sliding contact surface of the slider 63 sliding on the guide surface 46. When the shaft 40 is in the front portion 59*a*, the guide recess 60 engages the collar 44 of the guide pin 41. The stopper receiver 58*a* to engage the stopper 48 is formed on the front end edge of the door mounting member 58.

Figure 8:
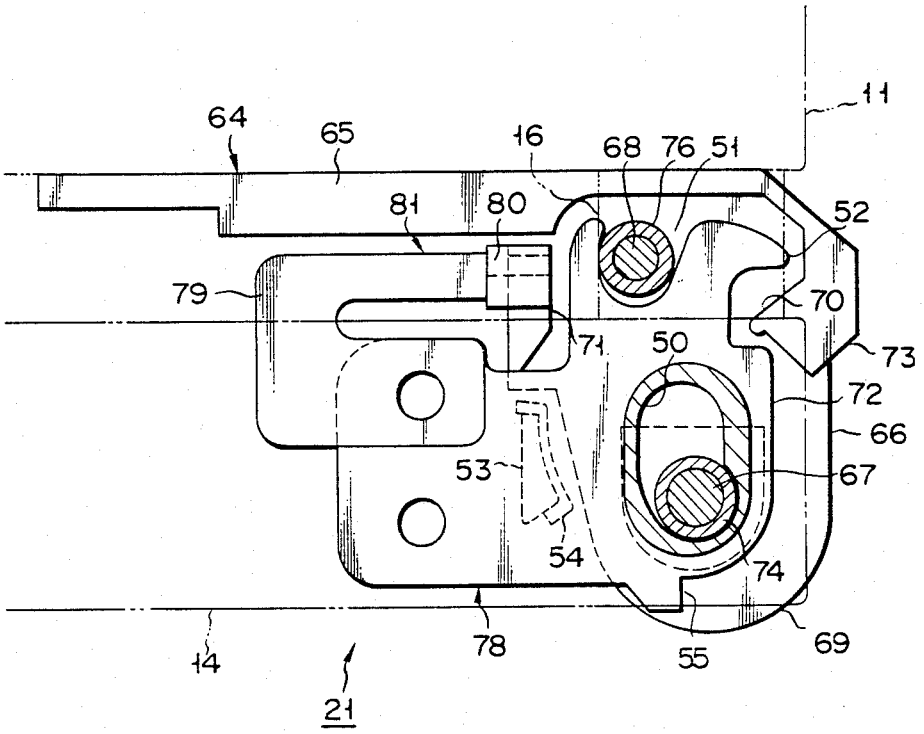
FIG. 8 is an enlarged cross-sectional view of a door hinge device at the lower portion of the side edge of the refrigerator.
Figure 9:
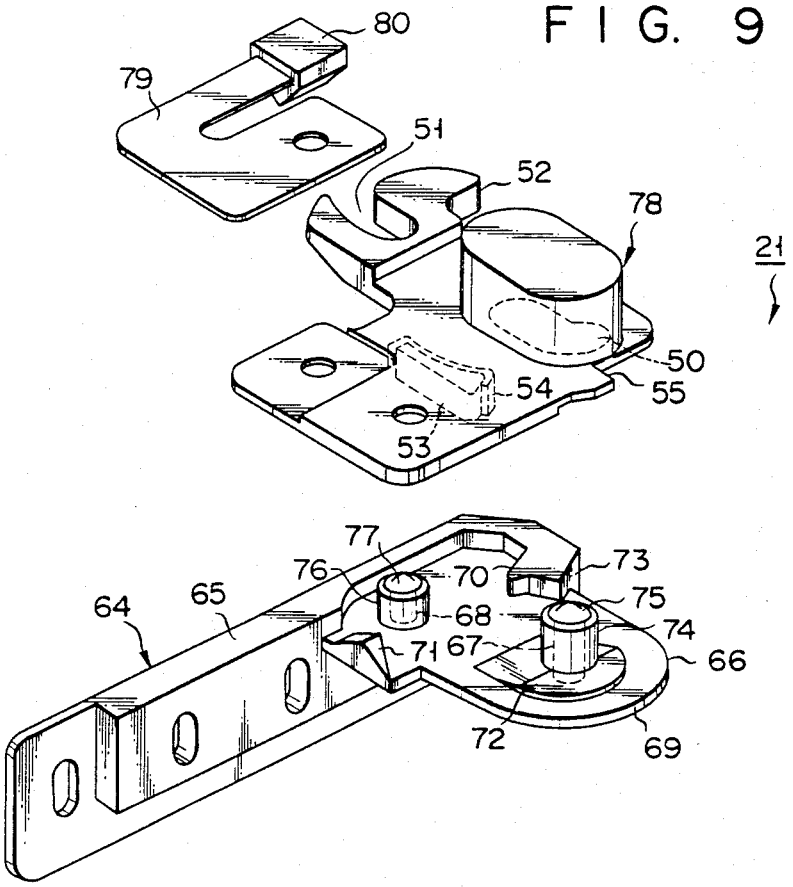
FIG. 9 is a disassembled perspective view of the door hinge device of FIG. 8.
Figure 10:
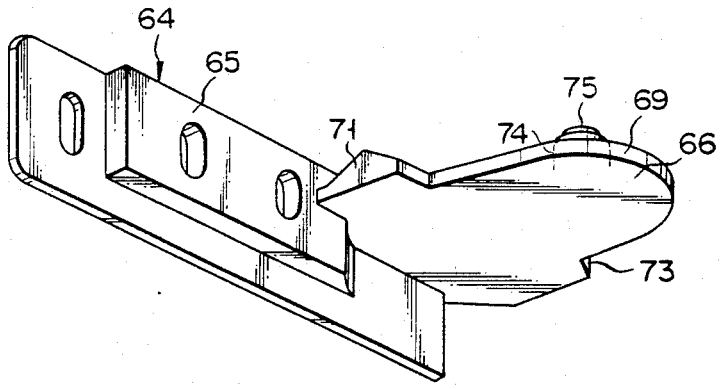
FIG. 10 is perspective underside view of a door support member of the door hinge device of FIG. 8.

Referring now to FIGS. 8 to 10, the door hinge device 21 will be described in detail. In FIG. 8, the refrigerator housing 11, sealing member 16 and door 14 are shown by two dot-chain lines. Like the door support member 23, a door support member 64 of the door hinge device 21 includes an elongated mounting portion 65 and a tongue 66 at one end portion of the mounting portion 65. The mounting portion 65 is fixed to the right end portion of the lower end edge of the refrigerator housing 11. Unlike the tongue 25, the tongue 66 has no shaft on its lower surface, though a shaft 67 and a guide pin 68 similar to the shaft 26 and the guide pin 29, respectively, stand on the upper surface of the tongue 66. A spacer 72 similar to the spacer 36 is fitted on the lower end portion of the shaft 67 and is fixed to the tongue 66. Cylindrical collars 74 and 76 are loosely fitted on the shaft 67 and the guide pin 68, respectively, for rotation. The collars 74 and 76 are prevented from slipping off the shaft 67 and the guide pin 68 by screws 75 and 77 attached to the upper end portions of the shaft 67 and the guide pin 68, respectively. The front end edge of the tongue 66 defines a guide surface 69 which, like the guide surface 32, is in the shape of a semicircular arc around the shaft 67. A guide 70 similar to the guide 33 is formed at that end portion of the tongue 66 which is on the right of the guide pin 68. A protrusion 71 similar to the protrusion 35 is formed at that end portion of the tongue 66 which is on the left of the guide pin 68. A stopper 73 similar to the stopper 48 is provided on the right end edge of the tongue 66. A door mounting member 78 constituting the door hinge device 21 has substantially the same construction as the door mounting member 49. Therefore, like reference numerals are used to designate the same portions of the door mounting member 78 as those of the door mounting member 49. The door mounting member 78 is attached to the right end portion of the lower end face of the door 14. A moving member 79, a slider 80, and the protrusion 71 constitute a toggle joint 81. The collar 74 of the shaft 67 is fitted in the shaft fitting slot 50, and the collar 76 of the guide pin 68 engages the guide recess 51.

Figure 11:
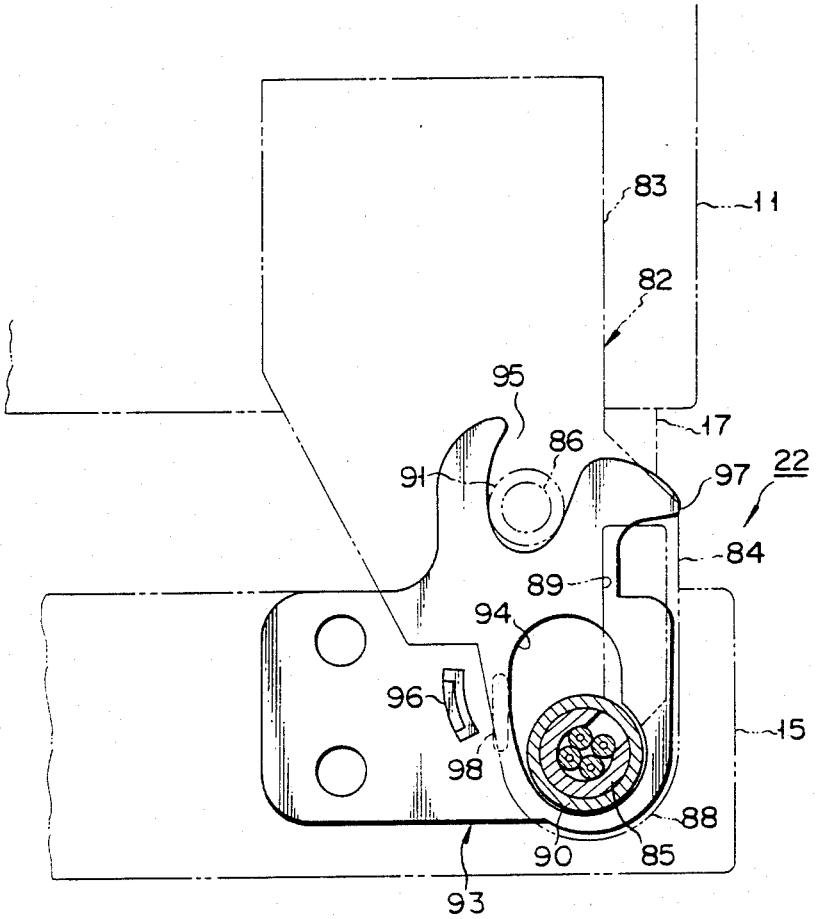
FIG. 11 is an enlarged cross-sectional view of a door hinge device at the upper portion of the side edge of the refrigerator.
Figure 12:
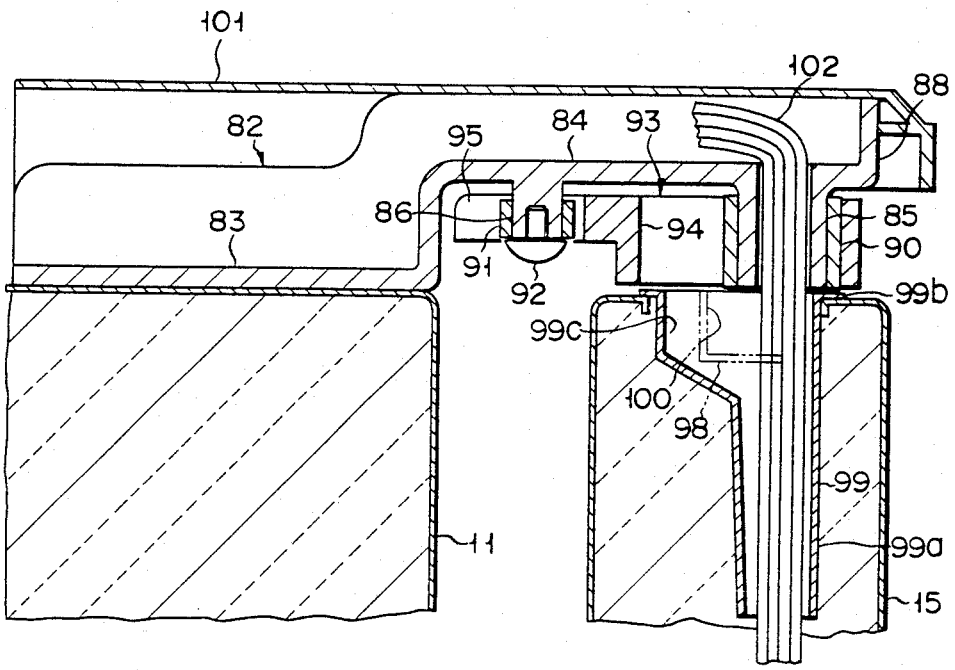
FIG. 12 is a vertical sectional view of the door hinge device of FIG. 11.
Figure 13:
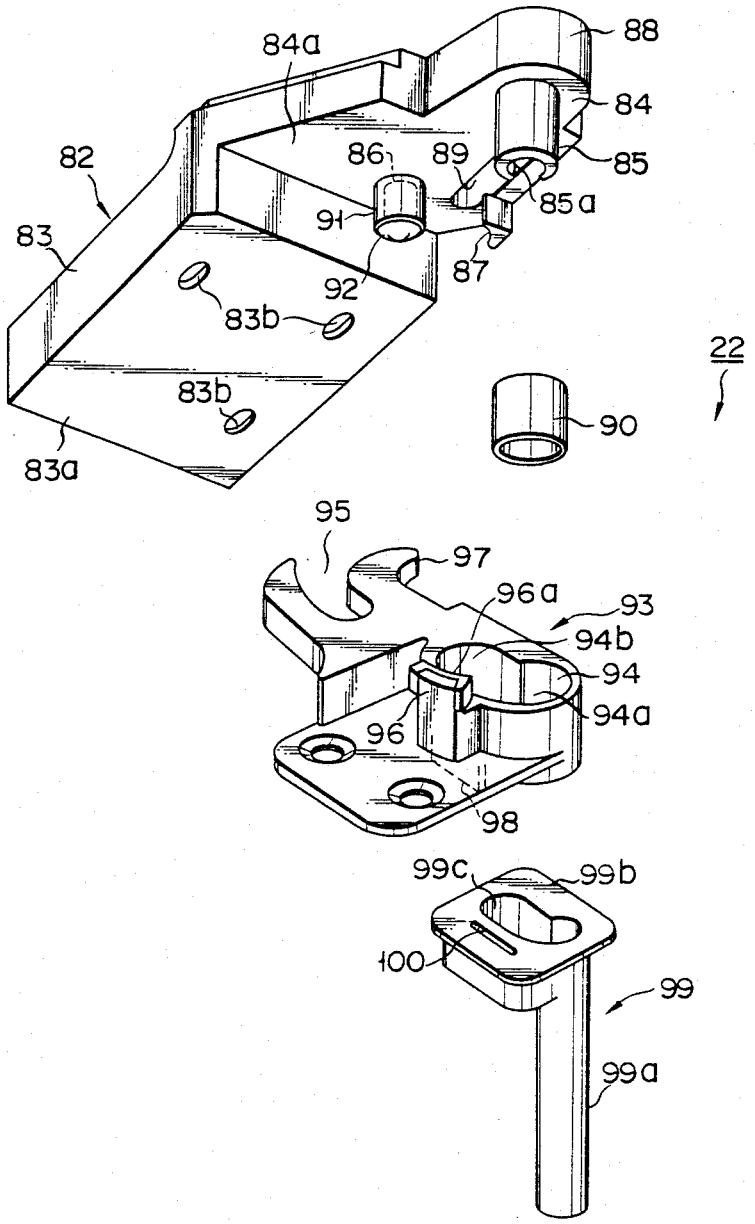
FIG. 13 is a disassembled perspective view of the door hinge device of FIG. 11.

Referring now to FIGS. 11 to 14, the door hinge device 22 will be described in detail. In FIG. 11, the refrigerator housing 11, sealing member 17 and door 15 are shown by two dot-chain lines. As shown in FIG. 13, the door hinge device 22 is formed of a door support unit 82 and a door mounting unit 93. The door support member 82 is attached to the right end portion of the upper end face of the refrigerator housing 11, while the door mounting member 93 is attached to the right end portion of the upper end face of the door 15 by means of a lead wire bush 99. The door support member 82 includes a mounting portion 83 having a substantially horizontal flat surface 83*a* and a tongue 84 formed in front of the mounting portion 83 and having a substantially horizontal flat surface 84*a*. Three holes 83*b* are bored through the mounting portion 83. Three holes 83*b* are bored through the mounting portion 83. The mounting portion 83 is fixed to the upper end face of the refrigerator housing 11 by means of bolts (not shown) fitted in the holes 83*b*. A substantially cylindrical shaft 85 is formed at the front end portion of the lower surface of the tongue 84, extending at right angles to the flat surface 84*a*. A hole is bored through that region of the flat surface 84*a* of the tongue 84 which is defined by the inner peripheral edge of the shaft 85. A lead wire slot 89 extending along the depth of the refrigerator housing 11 is bored through the flat surface 84*a* of the tongue 84. The lead wire slot 89 is connected to the hole defined by the inner peripheral edge of the shaft 85. A longitudinally extending opening portion 85*a* is formed in that portion of the peripheral wall of the shaft 85 which corresponds in position to the connecting region between the lead wire slot 89 and the hole defined by the inner peripheral edge of the shaft 85. The front end edge of the tongue 84 is curved in the shape of a semicircular arc around the shaft 85. A guide surface 88 is defined by the arcuate end edge. A guide pin 86 is provided on the rear end portion of the lower surface of the tongue 84, extending at right angles to the flat surface 84*a*. A cylindrical collar 91 is loosely fitted on the guide pin 86, and is prevented from slippling off therefrom by a screw 92 attached to the lower end portion of the guide pin 86. A guide 87 protrudes from the lower surface of the tongue 84 on the right of the guide pin 86. A cylindrical collar 90 is loosely fitted on the shaft 85.

Figure 14:
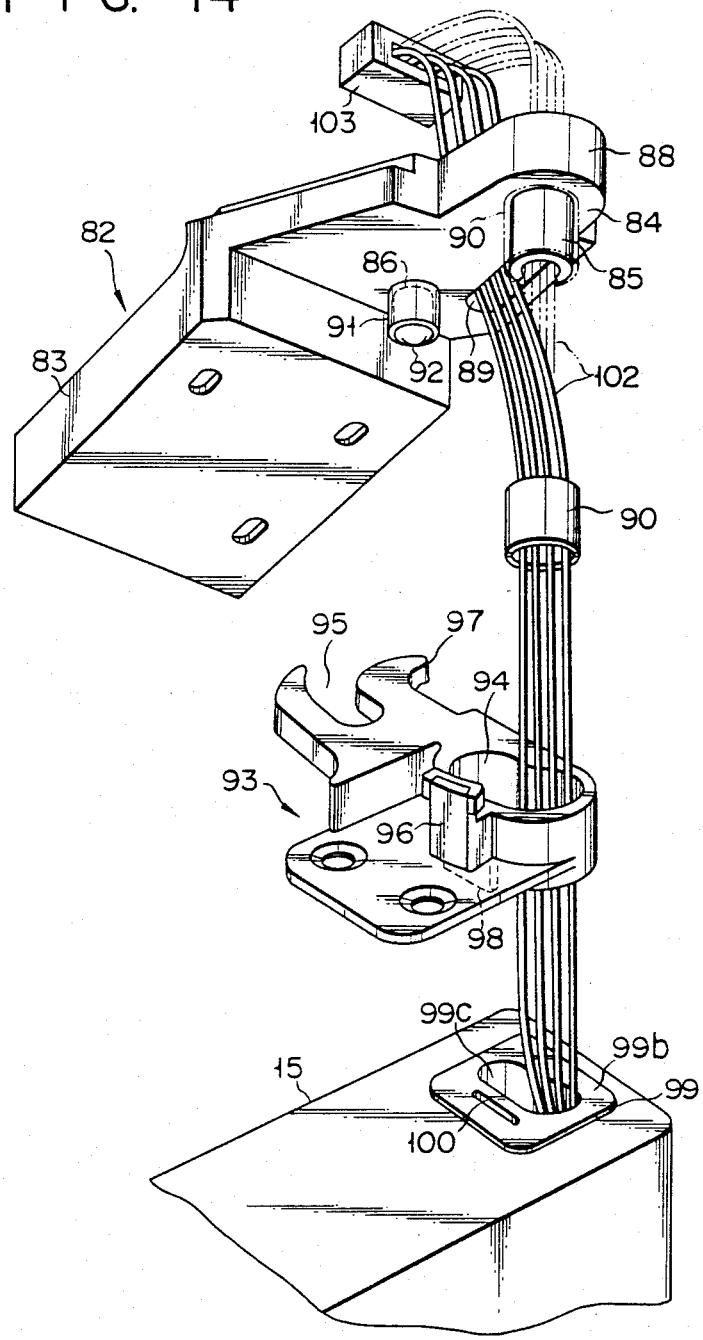
FIG. 14 is a disassembled perspective view illustrating the arrangement of lead wires of the door hinge device of FIG. 11.

The door mounting member 93 has a shaft fitting slot 94 extending along the depth of the refrigerator housing 11 at the right-hand portion of the front half of the mounting member 93. The shaft slot 94 vertically penetrates the door mounting member 93. A guide 96 is provided on the upper surface of the door mounting member 93 on the left of the shaft fitting slot 94. A slider 96*a* is attached to that surface of the guide 96 which faces the slot 94. The surface of the slider 96*a* is located on an arc of a circle whose center lies on the center of a rear portion 94*b* of the slot 94 and whose radius is equal to the radius of curvature of the guide surface 88. A flat protrusion 98 protrudes downward from the lower surface of the door mounting member 93 on the left of the slot 94. A guide recess 95 is formed in the rear half of the door mounting member 93. A guide click 97 protrudes to the right on the right of the guide recess 95. The lead wire bush 99 has a cylindrical tube portion 99*a* and a flange portion 99*b* on the top of the tube portion 99*a*. The flange portion 99*b* has a slot 99*c* which corresponds to the shaft fitting slot 94 when the flange portion 99*b* is held against the lower surface of the door mounting member 93 with the inner peripheral edge of the tube portion 99*a* in alignment with a front portion 94*a* of the slot 94. In this case, a depression 100 corresponding in shape to the protrusion is formed in alignment with the protrusion 98. Thus, if the lead wire bush 99 is joined with the door mounting member 93 so that the protrusion 98 is fitted in the depression 100, the slot 94 is aligned with the slot 99*c* of the flange portion 99*b*. As shown in FIG. 14, the lead wire bush 99 is buried in the upper end portion of the door 15 so that only the surface of the flange portion 99*b* is exposed. The door mounting member 93 is attached to the upper end portion of the door 15 so that the protrusion 98 is fitted in the depression 100. As shown in FIG. 14, lead wires 102 for a refrigerator driving motor and/or for illumination are passed through the lead wire slot 89, the collar 90, the shaft fitting slot 94, and the lead wire bush 99. The bush side ends of the lead wires 102 are led into the door 15. The door support member side ends of the lead wires 102 are led out of the refrigerator housing 11 on the upper end face side thereof, and are connected with a connector 103. In mounting the door 15 on the refrigerator housing 15, the lead wires 102 inside the lead wire slot 89 are moved into the shaft 85 through the opening portion 85*a*, and the collar 90 is fitted on the shaft 85, as indicated by two dot-chain lines in FIG. 14. Then, the collar 90 loosely fitted on the shaft 85 is fitted in the front portion 94*a* of the slot 94, while the guide recess 95 is caused to engage the collar 91 which is loosely fitted on the guide pin 86. Thus, the collar 90 prevents the lead wires 102 from slipping out of the shaft 85.

Figure 15:
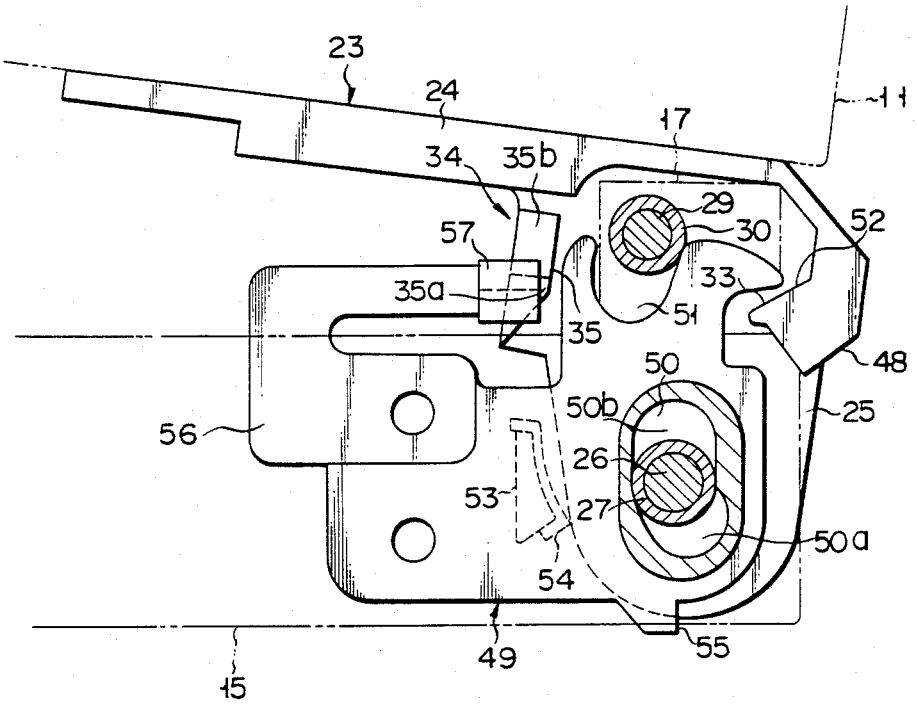
FIGS. 15 to 19 are enlarged cross-sectional views illustrating the operation of the door hinge device of FIG. 4.
Figure 16:
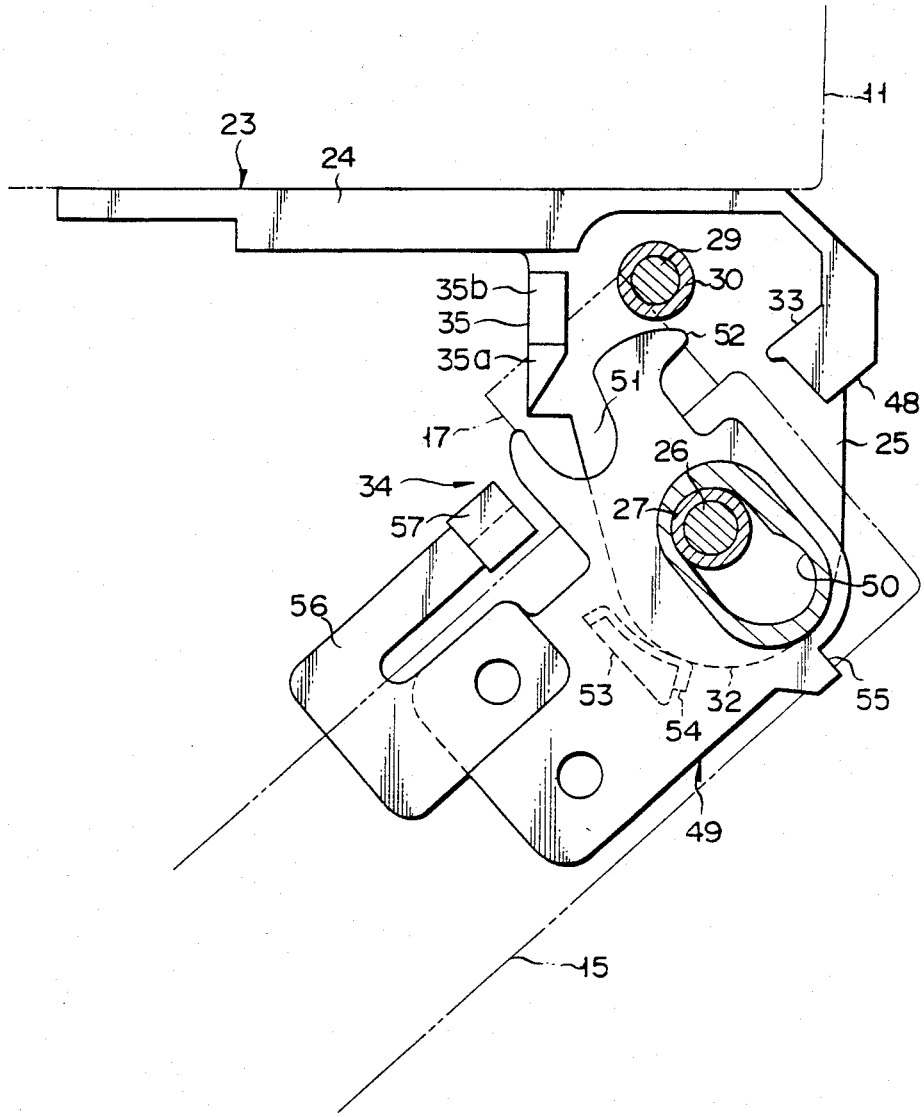
Figure 17:
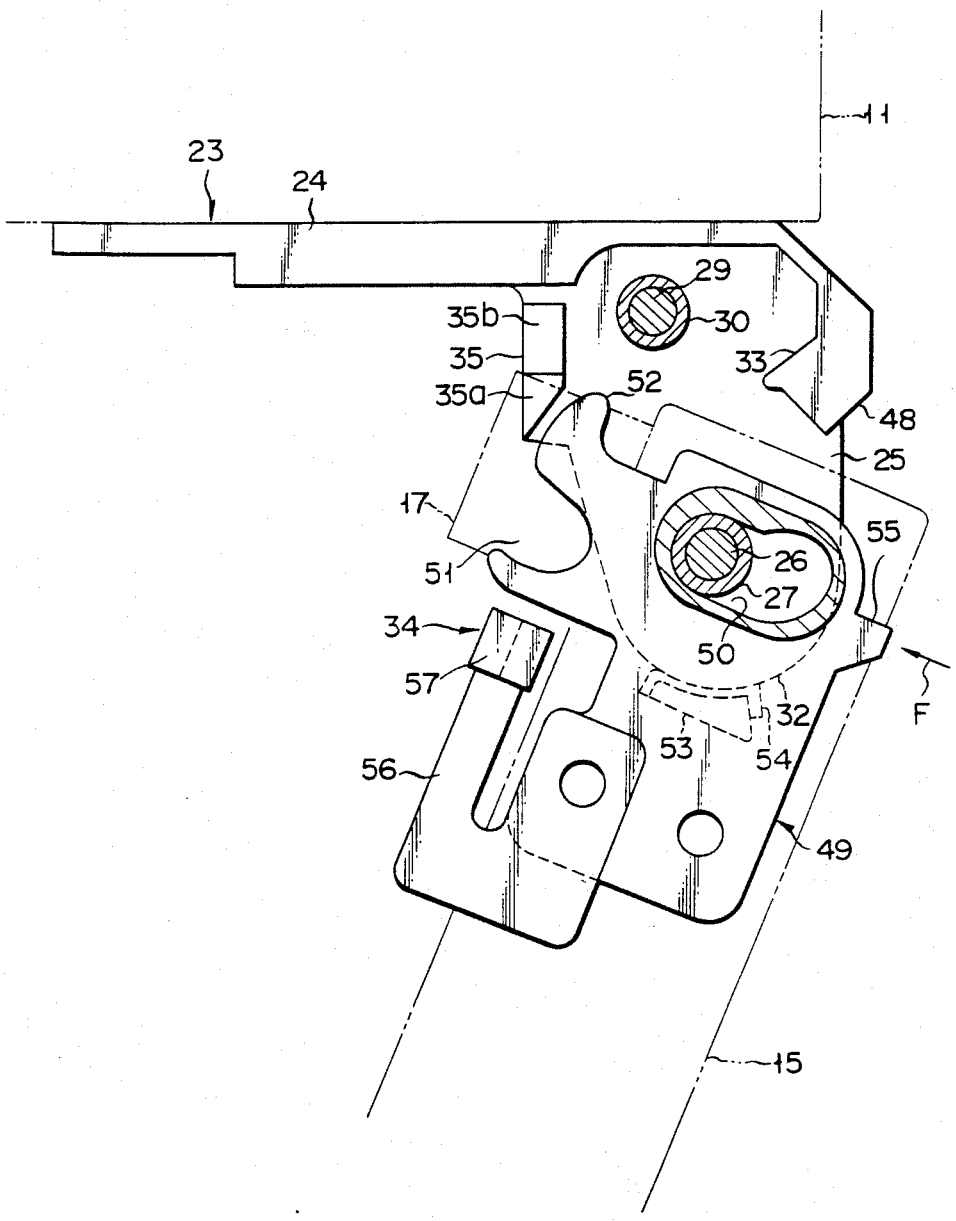
Figure 18:
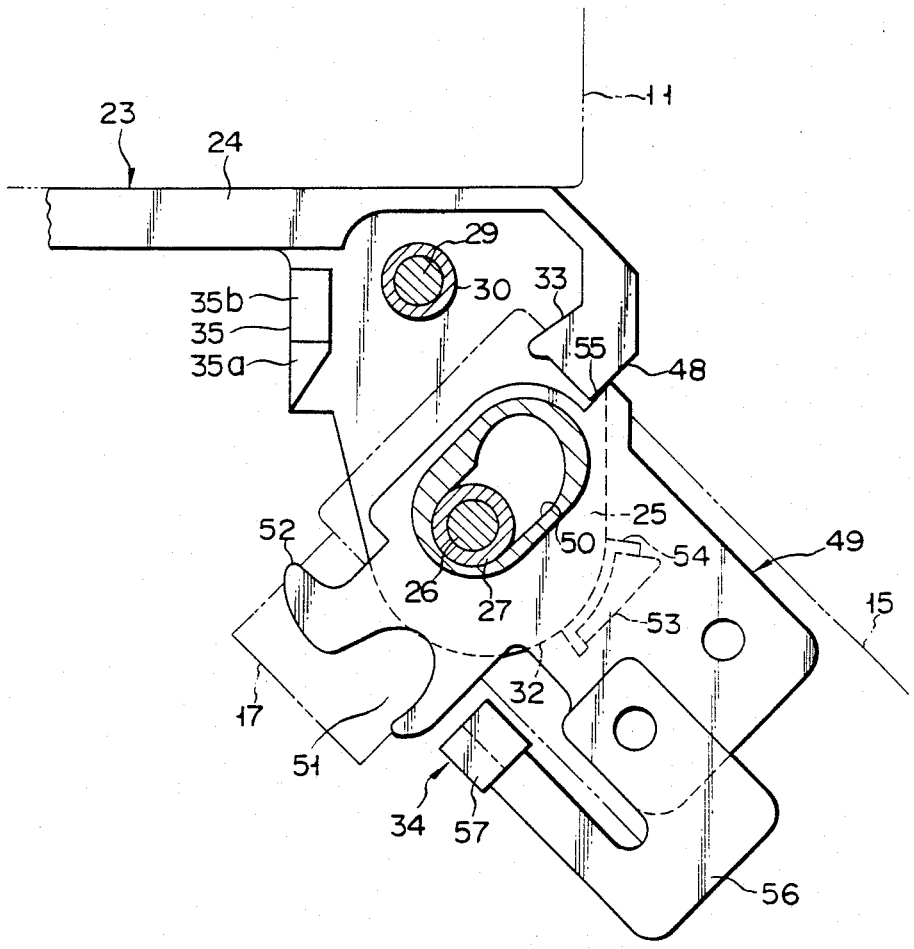

Referring to FIGS. 4 and 15 to 19, the operation of the door hinge device 20 for the swinging action of the door 15 will now be described. In FIGS. 15 to 19, the refrigerator housing 11, sealing member 17 and door 15 are shown by two dot-chain lines. FIG. 4 shows how the door support member 23 and the door mounting member 49 engage each other when the door 15 is closed. The shaft 26 is located in the front portion 50*a* of the shaft fitting slot 50, and the guide pin 29 is fitted in the guide recess 51. The slider 57 of the toggle joint 34 is in contact with the rear slanting surface 35*b* of the protrusion 35. If you pull the handle 19 of the door 15 toward you, the slider 57 of the toggle joint 34 gets cover the summit portion of the protrusion 35 against the elastic force of the moving member 56, so that the toggle joint 34 is disengaged. Although subjected to a rocking force around the shaft 26, the door 15 will never swing since the guide pin 29 is caught in the guide recess 51. By the forward tractive force acting on the door 15, therefore, the shaft 26 is moved relatively in the slot 50 from the front portion 50*a* thereof to the rear portion 50*b*, as shown in FIG. 15. Thereupon, the door 15 moves forward as a whole separating from the opening 13*a* of the freezing chamber 13 in such away that it is kept substantially parallel to the opening 13*a*. Thus, the sealing member 17 (FIG. 3) of the door 15 is prevented from rubbing against the edge portion 13*b* of the freezing chamber 13 while the door 15 is being opened. If you further pull the handls 19 of the door 15 toward you, the shaft 26 reaches the rear portion 50*b* of the shaft slot 50 so that the guide pin 29 is disengaged from the guide recess 51, as shown in FIG. 16. As a result, the door 15 is allowed to swing. The door mounting member 49 rocks around the shaft 26 with the collar 27 of the shaft 26 fitted in the rear portion 50*b* of the shaft fitting slot 50. While the door mounting member 49 is rocking, the slider 54 of the guide 53 is in sliding contact with the guide surface 32, so that the shaft 26 and the slot 50 are prevented from moving relatively in the longitudinal direction of the shaft slot 50. Thus, while the door mounting member 49 is rocking, the shaft 26 is always located in the rear portion 50*b* of the shaft slot 50. Accordingly, the door 15 is allowed to swing around the axis of the shaft 26 which is in alignment with the center of the rear portion 50*b*. Even if an external force F is applied in the longitudinal direction of the slot 50 to the door 15 in the middle of its swinging action, as shown in FIG. 17, the door mounting member 49 will never move relative to the door support member 23 in the longitudinal direction thereof, since the slider 54 of the guide 53 is in contact with the guide surface 32. Accordingly, the door 15 can swing smoothly around the shaft 26 without play. Since the door 15 swings only after moving forward from the refrigerator housing 11, the sealing member 17 will never rub against the front face of the refrigerator housing 11 during the swinging action of the door 15. If the handle 19 of the door 15 is pulled further, the stopper receiver 55 engages the stopper 48 to stop the door 15 from swinging, as shown in FIG. 18.

Figure 19:
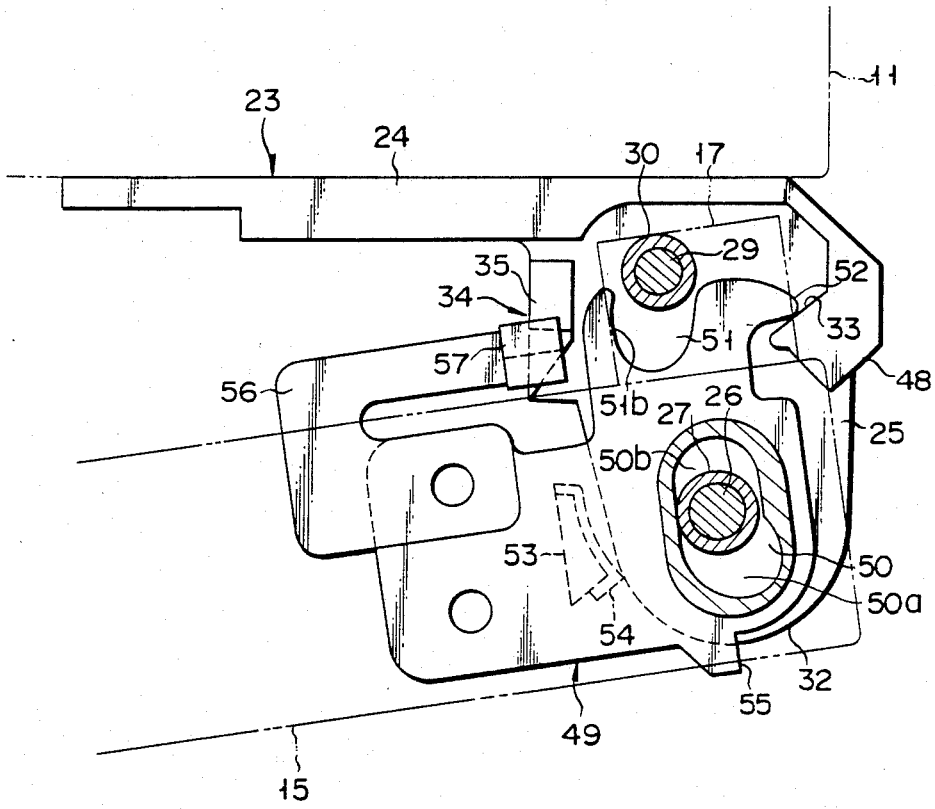

Now the closing action of the door 15 will be described. If subjected to a working force for closing, the door 15 swings from the position shown in FIG. 18 through the position of FIG. 17 to the position of FIG. 16. In an additional closing force is applied to the door 15, the guide click 52 abuts against the guide 33, as shown in FIG. 19. While the guide click 52 slides on the guide 33, the shaft 26 moves in the shaft fitting slot 50 from the rear portion 50*b* thereof to the front portion 50*a*. The joint actions between the guide click 52 and the guide 33 and between the shaft 26 and the slot 50 guide the guide recess 51 toward the guide pin 29. When the guide recess 51 engages the guide pin 29, the door mounting member 49 moves in a substantially straight line toward the refrigerator housing 11 so that a left edge portion 51*b* of the guide recess 51 is in contact with the collar 30 of the guide pin 29. After the guide click 52 comes into sliding contact with the guide 33 in this manner, the door 15 moves in a substantially straight line to approach the refrigerator housing 11 as a whole. When the guide pin 29 fully engages the guide recess 51, the sealing member 17 of the door 15 is brought into close contact with the edge portion 13*b* of the freezing chamber 13. In approaching the opening 13*a* of the freezing chamber 13, the door 15 moves as a whole toward the refrigerator housing 11 so that it is kept substantially parallel to the front face of the refrigerator housing 11. Accordingly, the sealing member 17 is prevented from rubbing against the front face of the refrigerator housing 11.

In the position shown in FIG. 19, the door mounting member 49 is on the flat surface 37 of the spacer 36. When the door mounting member 49 moves a little from this position to approach the refrigerator housing 11, the door mounting member 49 slides down the slanting surface 38 of the spacer 36 onto the flat surface 39, urged by the load of the door 15. Thus, the door 15 is drawn near the opening 13*a* of the freezing chamber 13 of the refrigerator housing 11. The slider 57 of the toggle joint 34 gets over the summit portion of the protrusion 35 to slide down the rear slanting surface 35*b*. Since the slider 57 is urged downward by the elastic force of the moving member 56, the door 15 is drawn nearer to the opening 13*a* of the freezing chamber 13 after the slider 57 rides across the summit portion of the protrusion 35. The toggle joint 34 serves to absorb the reaction of the door 15 caused when the door 15 runs against the edge portion 13*b* of the freezing chamber 13.

In opening and closing the door 15, the door hinge device 22 at the upper end portion of the refrigerator housing 11 acts in the same manner as the door hinge device 20. In swinging the door 14, on the other hand, the door hinge device 20 and the device 21 at the lower end portion of the refrigerator housing 11 act in the aforementioned manner.

In the embodiment described above, the shafts 26, 67 and 85 and the guide pins 29, 68 and 86 are provided on the door support members 23, 64 and 88, respectively, while the shaft slots 50, 59, 50 and 94 and the guide recesses 51, 60, 51 and 95 are formed in the door mounting members 49, 58, 78 and 93, respectively. In contrast, however, the shafts and the guide pins may be provided on the door mounting members, while the shaft slots and the guide recesses may be formed in the door support members. In the above embodiment, moreover, the guide surfaces 32, 46, 69 and 88 are formed on the door support members, while the guides 53, 62 and 96 are provided on the door mounting members. Alternatively, the guide surfaces and the guides may be formed on the door mounting members and the door support members, respectively.

In opening the door of a repository, as described above, the door is swung open only after it is moved forward from the housing of the repository. In closing, the door is swung in a position away from the repository housing, and is then moved substantially parallel to and brought into close contact with the repository housing. Accordingly, a sealing member attached to the door will never rub against the front face of the repository housing. Thus, the door can be opened and closed lightly. The functional life of the sealing member may be improved since it will not be damaged by repeated sliding contact. And, since the door is swung and moved smoothly, it can be opened and closed with ease.

What we claim is:

1. A door hinge for a repository of the type having a repository housing with an opening in one face thereof and an edge portion defining the opening, a door member to open and close the opening of the repository housing, and a sealing member sandwiched between the edge portion and the door member to seal the door member and the repository housing when the opening of the repository housing is closed by the door member, the door hinge comprising:

a door-support member adapted to be mounted adjacent the edge portion of the repository housing and having a first coupling portion;

a door-mounted member adapted to be attached to that portion of the door member adjacent to the door-support member in position and having a second coupling portion for cooperatively connecting with the first coupling portion;

a shaft attached to one of said coupling portions;

means defining a shaft-fitting slot formed at the other coupling portion, the shaft being fitted in the shaft-fitting slot so that the shaft and the shaft-fitting slot can rock relative to one another and move relative to one another in a direction perpendicular to the face of the repository housing where the opening is formed;

a guide pin attached to one of said coupling portions; and means defining a guide recess formed at the other of said coupling portions for engaging the guide pin;

the guide pin and the guide recess constraining movement of the shaft and the shaft-fitting slot relative to one another in a direction perpendicular to the face of the repository housing when the door member is moved between a closed and a nearly closed position, and permitting the shaft and the shaft-fitting slot to rock relative to one another when swinging said door member between a nearly closed position and a fully open position wherein said rocking causes said door mounting member to rock relative to said door-support member thereby swinging said door to a fully open position.

2. A door hinge device according to claim 1, wherein said door support member has a mounting portion attached close to the edge portion of the repository housing, and said first coupling portion has a tongue extending from the mounting portion toward the front of the repository housing.

3. A door hinge device according to claim 2, wherein said shaft is fixedly standing on the front portion of the tongue.

4. A door hinge device according to claim 3, further comprising a shaft collar loosely fitted on the shaft so as to be able to rock relative thereto.

5. A door hinge device according to claim 3, wherein said guide pin is fixedly standing on the rear portion of the tongue.

6. A door hinge device according to claim 5, further comprising a guide pin collar loosely fitted on the guide pin so as to be able to rock relative thereto.

7. A door hinge device according to claim 2, wherein said tongue has a guide, and said second coupling portion has a guide clock so that the guide click abuts against the guide to stop the door member from swinging when the door member rocks in the direction to close the opening of the repository housing, and then slides on the guide to lead the guide recess toward the guide pin.

8. A door hinge device according to claim 7, further comprising a toggle joint, the toggle joint having a U-shaped flat moving member one end of which is fixed to the door-mounted member, a slider fitted to the other end of the flat moving member, and a protrusion provided on the door support member for engaging with the slider.

9. A door hinge device according to claim 7, further comprising a guide surface formed at the front end portion of the tongue and curved in the shape of a semicircular arc around the central axis of the shaft, and a rocking guide provided on that surface of the second coupling portion which is in contact with the tongue for sliding on the guide surface when the door-mounted member rocks relative to the door support member.

10. A door hinge device according to claim 9, wherein said rocking guide has a plastic slider for sliding on the guide surface when the door-mounted member rocks relative to the door support member.

11. A door hinge device according to claim 7, further comprising a spacer fitted on the lower end of the shaft and fixed to the tongue, the spacer having a first flat surface formed at the front portion thereof as viewed in the direction away from the chamber, a second flat surface formed at the rear portion and lower in level than the first flat surface, and a slanting surface formed between the first and second flat surfaces.

12. A door hinge device according to claim 11, wherein the left and right portions of said slanting surface as viewed from the front of the repository housing are slightly deviated from each other in the direction of the chamber of the repository housing so that the portion of the slanting surface nearer to the opening of the repository housing lies behind the other half portion.

13. A door hinge device accordingto claim 11, further comprising means forming a depression in that surface of said second coupling portion which is in contact with the tongue to correspond to the shape of the spacer when the door member is closed.

14. A door hinge device according to claim 7, further comprising a stopper and a stopper receiver attached to said tongue and said second coupling portion, respectively, so that the stopper and the stopper receiver abut against each other to stop the door member from swinging when the door member is swung open until a given angle is formed between the door member and the repository housing.

* * * * *